US007201255B1

(12) United States Patent
Kreikemeier

(10) Patent No.: US 7,201,255 B1
(45) Date of Patent: Apr. 10, 2007

(54) APPARATUS AND METHOD OF FORMING A CORROSION RESISTANT COATING ON A LADDER

(76) Inventor: Robert D. Kreikemeier, 870 S. Broad St., Fremont, NE (US) 68025

( * ) Notice: Subject to any disclaimer, the term of this patent is extended or adjusted under 35 U.S.C. 154(b) by 299 days.

(21) Appl. No.: 10/764,362

(22) Filed: Jan. 23, 2004

(51) Int. Cl.
*E06C 5/00* (2006.01)
*E06C 7/00* (2006.01)

(52) U.S. Cl. ..... 182/2.5; 182/228.6

(58) Field of Classification Search ..... 182/194, 182/2.5, 228.1–228.6, 217–219
See application file for complete search history.

(56) References Cited

U.S. PATENT DOCUMENTS

| | | | | | |
|---|---|---|---|---|---|
| 149,669 | A | * | 4/1874 | Miller | 182/52 |
| 724,953 | A | * | 4/1903 | Schaller | 182/52 |
| 3,962,501 | A | | 6/1976 | Ohbu et al. | |
| 4,056,366 | A | | 11/1977 | Lee et al. | |
| 4,073,978 | A | | 2/1978 | Womack et al. | |
| 4,250,207 | A | | 2/1981 | Takahashi et al. | |
| 4,358,887 | A | | 11/1982 | Creps | |
| 4,480,166 | A | * | 10/1984 | Leech | 219/118 |
| 4,512,439 | A | * | 4/1985 | Howell | 182/66.2 |
| 4,634,487 | A | * | 1/1987 | Karo | 156/256 |
| 4,655,287 | A | | 4/1987 | Wu | |
| 4,852,690 | A | * | 8/1989 | Salmi | 182/219 |
| 5,106,237 | A | * | 4/1992 | Meldrum | 405/221 |
| 5,185,187 | A | | 2/1993 | Yashiki et al. | |
| 5,855,674 | A | | 1/1999 | Maitra et al. | |
| 6,534,196 | B2 | | 3/2003 | Betts | |

* cited by examiner

*Primary Examiner*—Alvin Chin-Shue

(57) ABSTRACT

A ladder structure for enhancing corrosion resistance is disclosed, which comprises a ladder including a pair of rails and a plurality of rungs extending between and mounted on the rails. At least one of the rails and at least one of the rungs of the ladder comprise substantially tubular elements each having an interior. A pair of the substantially tubular elements of the ladder are connected to each other and the interiors of the connected pair of substantially tubular elements are in fluid communication with each other. Also disclosed is a method of forming the ladder structure with enhanced corrosion resistance.

2 Claims, 4 Drawing Sheets

APPARATUS AND METHOD OF FORMING A CORROSION RESISTANT COATING ON A LADDER

BACKGROUND OF THE INVENTION

1. Field of the Invention

The present invention relates to methods of treating ladder structures for corrosion resistance and more particularly pertains to a new method of applying a corrosion resistant coating in a manner that is especially useful for aerial ladders and that produces a ladder structure with enhanced corrosion protection that extends over the entire ladder structure.

2. Description of the Prior Art

Ladders that are employed in firefighting, and especially those aerial ladders that are mounted on vehicles for use in firefighting, are especially vulnerable to corrosion. The ladders are typically made of steel, and are thus are particularly vulnerable to rusting. The constant rubbing contact between sections of the aerial ladder, as well as with other firefighting equipment carried by firefighters climbing the ladder, coupled with the frequent exposure to water, often leads to corrosion of the ladder that can seriously compromise the strength of the aerial ladder.

Various measures have been attempted to reduce or eliminate the corrosion of the ladder. Applying a paint or a galvanizing coating to the exposed surfaces of the ladder has been employed in an attempt to solve the corrosion problem, but the inability to completely cover all portions of the ladder structure, especially around the welds joining the members of the ladder structure, can leave some areas unprotected, and thus does not completely prevent the occurrence of corrosion, and can even lead to faster corrosion at the uncovered areas. Even if complete coverage is obtained initially, the aforementioned rubbing off (and nicking) of the coating compromises the protection.

More importantly, the interior of the tubular members that form the ladder structure may corrode from moisture that infiltrates the interiors of these elements, and this corrosion is potentially the most dangerous as it can go undetected from visual detection. In some cases, it is necessary to take the aerial fire trucks out of service so that the integrity of the elements of the aerial ladder can be examined closely and tested, but this involves additional costs and additional downtime for the firefighting vehicle.

In these respects, the method of applying corrosion resistant coating for aerial ladders according to the present invention substantially departs from the conventional concepts and designs of the prior art, and in so doing provides a method of applying corrosion resistant coating in a manner that is especially useful for aerial ladders and that results in a ladder structure with enhanced corrosion protection.

SUMMARY OF THE INVENTION

In view of the foregoing disadvantages inherent in the known types of methods and manners of resisting corrosion in ladder structures that have been practiced in the prior art, the present invention provides a new method of applying a corrosion resistant coating to a ladder.

To attain this, in one aspect of the present invention an apparatus is contemplated that generally comprises a ladder structure for enhancing corrosion resistance. The ladder structure includes a ladder having a pair of rails and a plurality of rungs extending between and mounted on the rails. At least one of the rails and at least one of the rungs of the ladder comprise substantially tubular elements each having an interior. A pair of the substantially tubular elements of the ladder are connected to each other and the interiors of the connected pair of substantially tubular elements are in fluid communication with each other.

In one embodiment of the invention, a first one of the connected pair of substantially tubular elements has a perimeter wall with a hole formed therein, and wherein a second one of the connected pair of substantially tubular elements has an opening located at an opposite end of the second substantially tubular element. Further, the first substantially tubular element may be connected to the second substantially tubular element in a manner such that the hole formed in the perimeter wall of the first substantially tubular element is in fluid communication with the opening in the end of the second substantially tubular element. Also, both of the rails and substantially all of the plurality of rungs may comprise substantially tubular elements with interiors, and wherein the interiors of substantially all of the rungs are in fluid communication with both of the rails.

In another aspect of the invention, a method of forming a ladder assembly that is resistant to corrosion is contemplated. The method comprises providing a plurality of substantially tubular elements, with each of the substantially tubular elements including a perimeter wall and opposite ends. At least one of the opposite ends of the substantially tubular elements has an opening. The method further comprises forming a hole in the perimeter wall of a first one of the substantially tubular elements, and aligning the opening in one of the opposite ends of a second one of the substantially tubular elements with the hole in the perimeter wall of the first one of the substantially tubular elements such that an interior of the first one of the substantially tubular elements is in fluid communication with an interior of the second one of the substantially tubular elements. The method additionally comprises connecting the second one of the substantially tubular elements to the first one of the substantially tubular elements in the alignment to form a joint of the ladder. The contemplated method also comprises dipping the joint of the first and second substantially tubular elements in a corrosion resisting liquid so that the corrosion resisting liquid is capable of moving between the interiors of the substantially tubular elements to coat the interiors of the first and second substantially tubular elements with the corrosion resisting liquid, including submerging the joint of the ladder in the corrosion-resisting liquid.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the ability to expose substantially all surfaces of a ladder structure to a corrosion resistant fluid to enhance the capability of those surfaces to be coated with a layer of the corrosion resistant coating.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

With reference now to the drawings, and in particular to FIGS. 1 through 4 thereof, a new method of applying corrosion resistant coating for aerial ladders embodying the principles and concepts of the present invention will be described.

The invention contemplates a ladder structure 10 for a vehicle that exhibits enhanced corrosion resistance, and also a method of forming or fabricating the ladder structure 10 to achieve the enhanced corrosion resistance.

Figure 1:
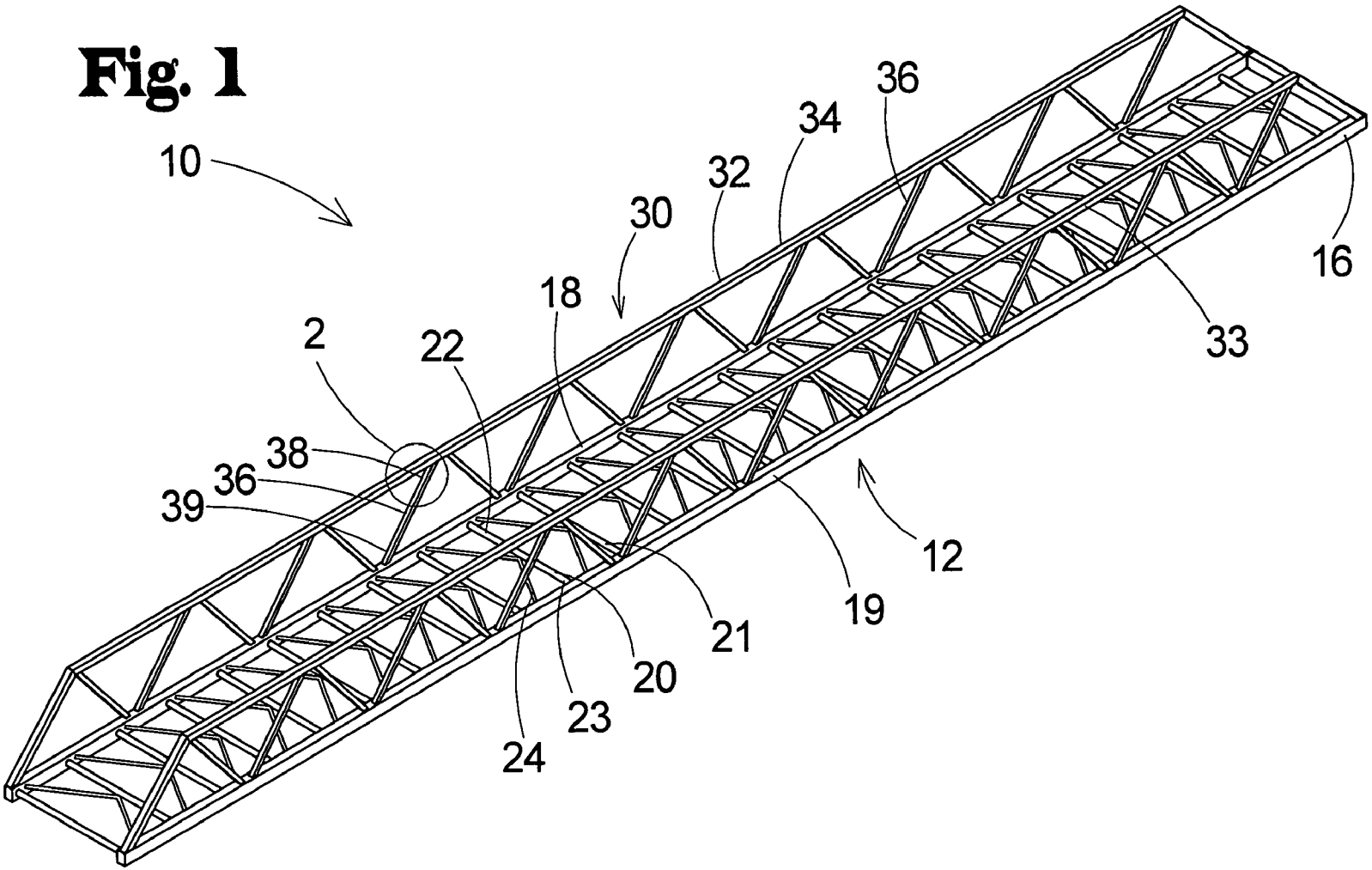
FIG. 1 is a schematic perspective view of an aerial ladder structure according to the present invention.
Figure 2:
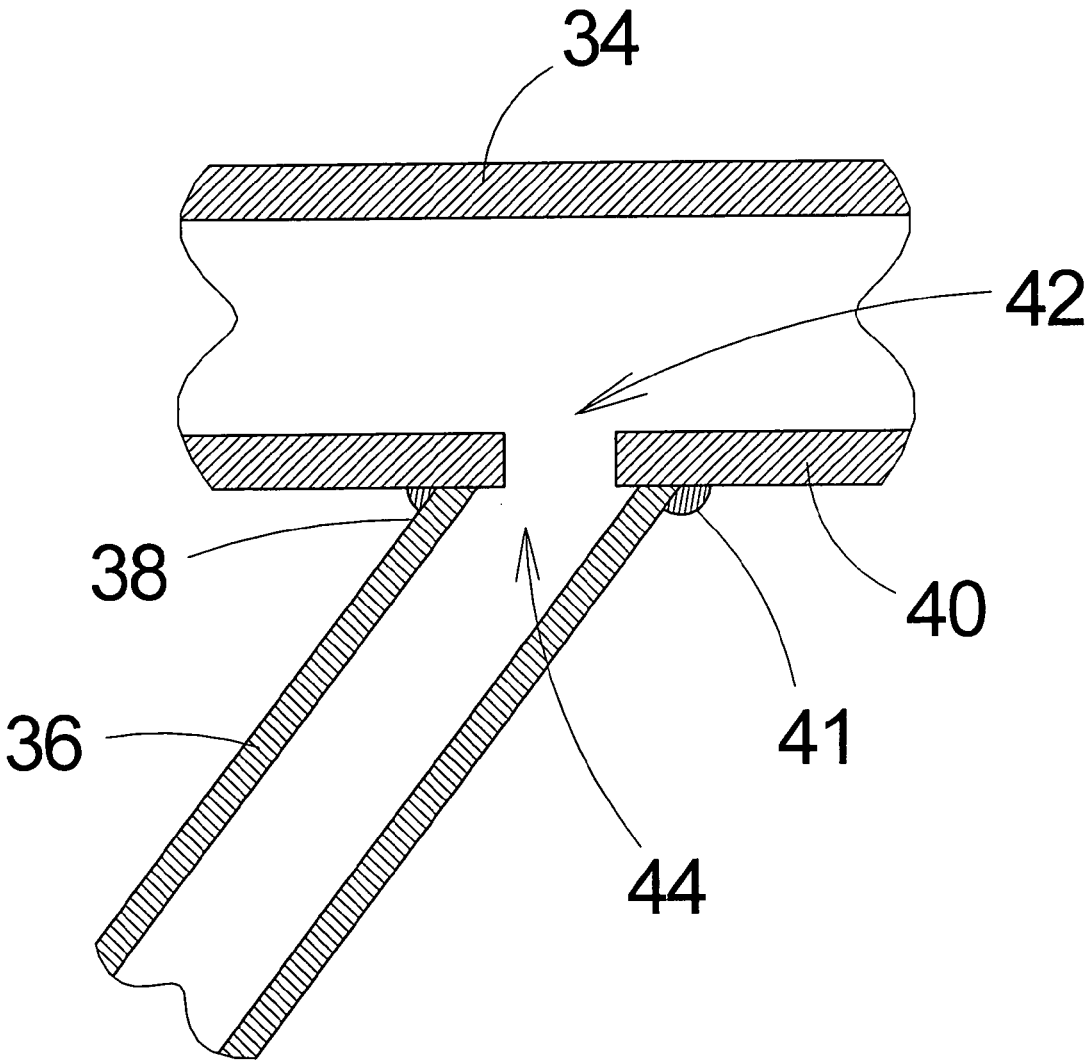
FIG. 2 is a schematic enlarged sectional view the portion of the present invention shown circled in FIG. 1 and indicated by the numeral "2".

In the apparatus aspect of the invention, the ladder structure 10 comprises a ladder 12, and a ladder support 30 for enhancing rigidity of the ladder 12 when the ladder is supported at an end in an extended condition (see FIG. 1). The ladder 12 has a first end 14 and a second end 16. The ladder 12 may include a pair of rails 18, 19 that extend between the first 14 and second 15 ends. The ladder 12 may also include a plurality of rungs 20, 21 that extend between the rails 18, 19. Each rung 20, 21 may have opposite ends 22, 23 that are each mounted on one of the rails 18, 19. In one embodiment of the invention, the ladder 12 includes a plurality of buttresses 24, and each buttress extends between one of the rails 18, 19 and a medial region of one of the rungs 20, 21.

Significantly, at least one of the rails 18, 19 and at least one of the rungs 20, 21 is a substantially tubular element. Optionally, at least one of the buttresses 24 is a substantially tubular element. Each of the tubular elements defines an interior 25 that may be substantially hollow.

The ladder support 30 of the ladder structure 10 may be mounted on the ladder 12. The ladder support 30 may includes at least one truss assembly 32, and typically includes a pair of truss assemblies 32, 33. Each truss assembly 32, 33 may include at least one longitudinal member 34 that extends along one of the rails 18, 19 of the ladder 12 in a spaced and substantially parallel relationship to the rail. The truss assembly 32, 33 may also include a plurality of cross members 36 that extend between the longitudinal member 34 and the rail of the ladder 12. In at least one embodiment of the invention, the longitudinal member 34 and at least one of the plurality of cross members 36 (and preferably all of the cross members) comprise substantially tubular elements. Each of the cross members 36 has a pair of opposite ends 38, 39, and a first one 38 of the opposite ends is mounted on the longitudinal member 34 and a second one 39 of the opposite ends is mounted on the rail 18.

Figure 3:
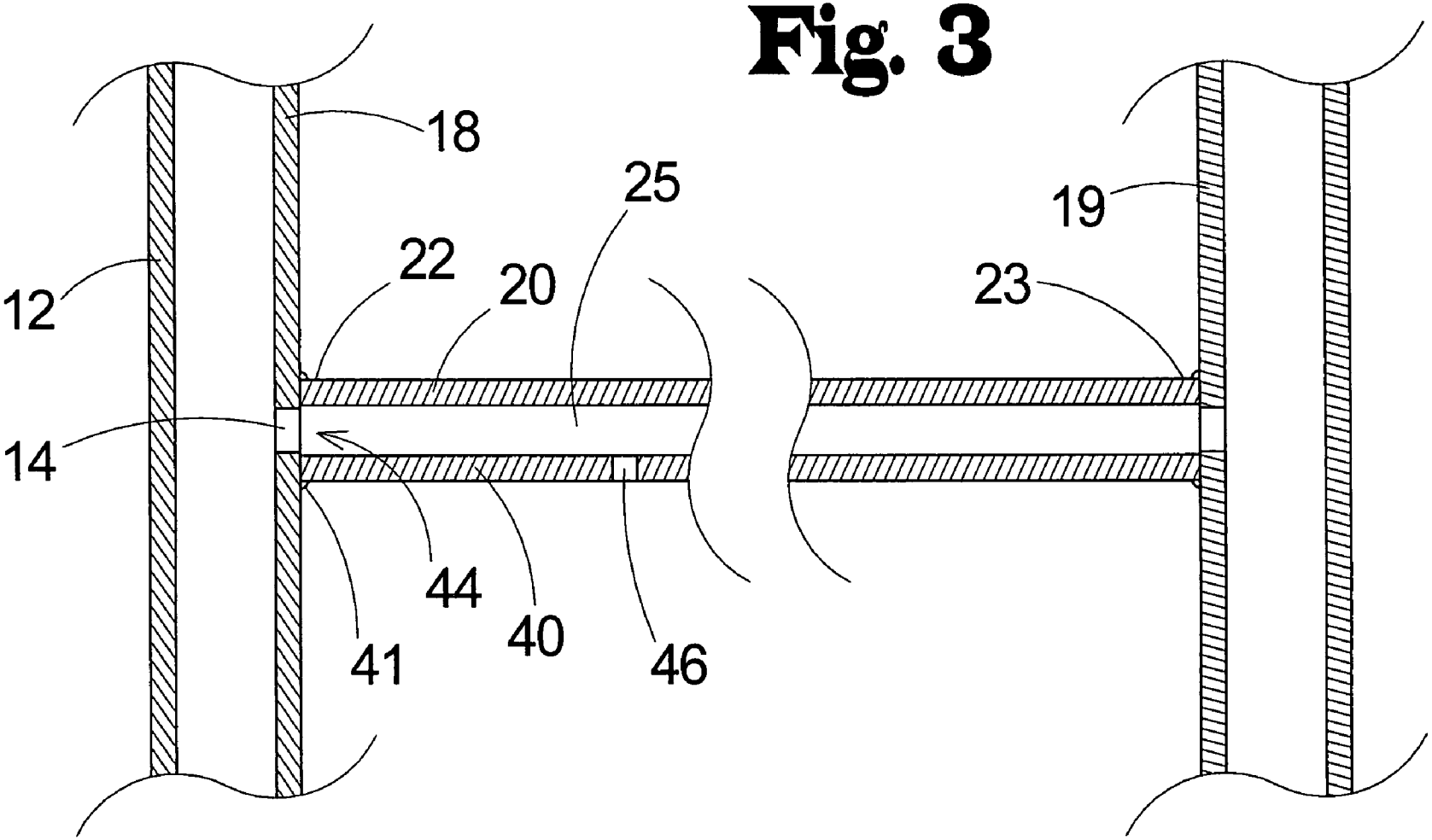
FIG. 3 is a schematic sectional view of a portion of the ladder of the present invention.
Figure 4:
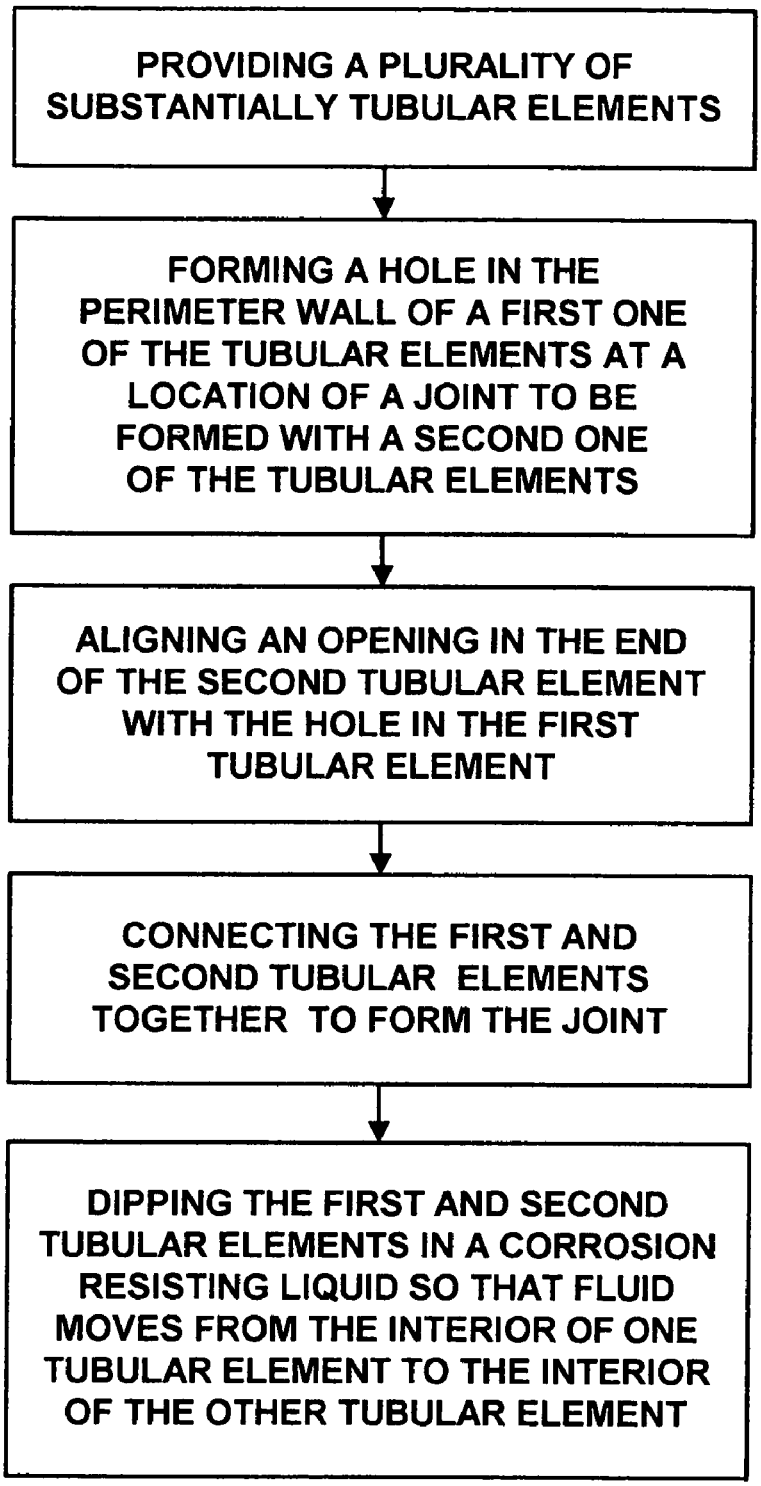
FIG. 4 is a schematic flow diagram of a method of the present invention.

In an embodiment of the invention, at least one of the rungs 20, 21 is mounted to at least one of the rails by welding by a weld 41 (see FIG. 3). Further, each of the buttresses 24 may be welded to the respective rungs 20, 21 and rails 18, 19. Similarly, the ends 38, 39 of the cross members 36 of the ladder support 30 may be welded by a weld 41 to the respective longitudinal member 34 of the support 30 and the rail 18, 19 of the ladder 12 (see FIG. 2).

In one embodiment of the invention, each of the tubular elements of the ladder structure 10 has a perimeter wall 40 that is substantially continuous between the ends of the element. Each of the tubular elements may have an opening 44 formed in at least one of the opposite ends of the element, and most preferably both of the opposite ends of the tubular element have an opening.

Significantly, the interior of at least one, and preferably each, of the tubular elements of the ladder structure 10 (such as, for example, element 36 in FIG. 2) is in fluid communication with the interior of at least one adjacent and connected tubular element (such as, for example, element 34 in FIG. 2) to permit fluid to move between the interiors of the tubular elements, or in other words, from the interior of one of the tubular elements to the interior of another one of the tubular elements.

To achieve this fluid communication between the interior of the adjacent and connected elements, a first one of the adjacent tubular elements is provided with a hole 42 that is formed in the perimeter wall 40 at a location where a second one of the adjacent tubular elements is to be connected to the first tubular elements to form a joint therebetween. The opening 44 of the second adjacent tubular element is positioned over the hole 42 of the first adjacent tubular element so that the opening 44 and the hole 42 are aligned or positioned in registry with each other and such that fluid in one of the tubular elements is able to substantially freely move into the other of the tubular elements.

Optionally, fluid flow into the interior of at least one of the tubular elements may be facilitated by an aperture 46 in the perimeter wall 40 of the tubular element that creates a path for fluid to flow from the exterior to the interior of at least one of the tubular elements, and thereby into the interiors of other tubular elements whose interiors are in communication with the tubular element having the aperture 46.

The invention also contemplates a method for forming the ladder structure 10 in a manner that resists corrosion of the ladder. The method includes the step or act of providing a plurality of substantially tubular elements, with each of the tubular elements including a perimeter wall 40 and opposite ends and with at least one of the opposite ends of each of the tubular elements having an opening 44. A hole 42 is formed in the perimeter wall of a first one of the tubular elements.

The opening 44 in one of the opposite ends of a second one of the tubular elements is aligned or put in registration with the hole 42 in the perimeter wall of the first one of the tubular elements. The first and second tubular elements are connected together in the aforementioned alignment, such as, for example, by welding the second tubular element to the first tubular element, to form a joint of the ladder. The assembly of the first and second tubular elements of the ladder are dipped or submerged in a corrosion resisting liquid to coat the assembly with the corrosion resisting liquid. The corrosion resistant liquid may include molten zinc to create a galvanizing coating on the surfaces, both interior and exterior, of the elements of the ladder.

Significantly, the coating of the interior surfaces of the tubular elements of the ladder is facilitated by the forming of a hole in the perimeter wall of the first one of the tubular elements where the opening in the end of the second one of the tubular elements is joined to the first tubular elements so that the corrosion resisting liquid may contact the entireties of the interior surfaces of the tubular elements. The flow of fluid (such as the corrosion resisting liquid) is thus not blocked by the perimeter wall of the adjacent tubular element, nor does air that is trapped in an end of a tubular element prevent the corrosion resisting liquid from contacting some portions of the interior of the tubular element.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ladder structure for enhancing corrosion resistance, comprising:

a ladder including a pair of rails and a plurality of rungs extending between and mounted on the rails;

wherein at least one of the rails and at least one of the rungs of the ladder comprise substantially tubular elements each having an interior;

wherein a pair of the substantially tubular elements of the ladder are connected to each other and the interiors of the connected pair of substantially tubular elements are in fluid communication with each other;

wherein the at least one rung has an end connected to the at least one rail at a connection, the end of the at least one rung being located outside of the interior of the at least one rail at the connection;

wherein a first one of the connected pair of substantially tubular elements has a perimeter wall with a hole formed therein, and wherein a second one of the connected pair of substantially tubular elements has an opening located at an opposite end of the second substantially tubular element;

wherein the first substantially tubular elements is connected to the second substantially tubular element in a manner such that the hole formed in the perimeter wall of the first substantially tubular elements is in fluid communication with the opening in the end of the second substantially tubular element;

wherein both of the rails and substantially all of the plurality of rungs comprise substantially tubular elements with interiors, and wherein the interiors of substantially all of the rungs are in fluid communication with both of the rails;

a support structure mounted on the ladder for enhancing rigidity of the ladder when the ladder is supported at an end in an extended condition;

wherein the support structure includes at least one substantially tubular element with an interior in fluid communication with at least one of the substantially tubular elements of the ladder;

wherein the support structure includes at least one truss assembly;

wherein the support structure includes at least one longitudinal member extending substantially parallel to one of the rails of the ladder, and a plurality of cross members extending between the longitudinal member and the said one rail of the ladder, wherein the longitudinal member and substantially all of the plurality of cross members comprise substantially tubular elements with interiors, wherein the interiors of substantially all of the cross members are in fluid communication with the interior of the longitudinal member;

wherein each of the cross members has a pair of opposite ends, a first one of the opposite ends being mounted on the longitudinal member and a second one of the opposite ends being mounted on the rail, at least one of the ends of the cross member being in fluid communication with the longitudinal member; and wherein the ladder includes a plurality, of buttresses, each of the buttresses extending between one of the rails and a medial region of one of the rungs, each of the buttresses being substantially tubular.

2. A ladder structure for enhancing corrosion resistance, comprising:

a ladder including a pair of rails and a plurality of rungs extending between and mounted on the rails;

wherein the rails and the rungs of the ladder comprise substantially tubular elements each having an interior;

wherein the interiors of each of the rungs are in fluid communication with the interior of at least one of the rails;

wherein each rung has opposite ends, the opposite ends being connected to a respective one of the rails, the ends of the rungs being located outside of the interiors of the rails;

wherein each of the rails has a perimeter wall with a hole formed therein, and wherein each of the rungs has an opening located at an end of the rung;

wherein at least one of the rungs is connected to at least one of the rails in a manner such that the hole formed in the perimeter wall of the rail is in fluid communication with the opening in the end of the at least one rung;

wherein the interiors of substantially all of the rungs are in fluid communication with at least one of the rails;

a support structure mounted on the ladder for enhancing rigidity of the ladder when the ladder is supported at an end in an extended condition;

wherein the support structure include at least one substantially tubular element with an interior in fluid communication with the interior of one of the rails;

wherein the support structure includes at least one truss assembly;

wherein the support structure includes at least one longitudinal member extending substantially parallel to lone of the rails of the ladder, and a plurality of cross members extending between the longitudinal member and the said one rail of the ladder, wherein the longitudinal member and substantially all of the plurality of cross members comprise substantially tubular elements with interiors, wherein the interiors of substantially all of the cross members are in fluid communication with the interior of the longitudinal member;

wherein each of the cross members has a pair of opposite ends, a first one of the opposite ends being mounted on the longitudinal member and a second one of the opposite ends being mounted on the rail, at least one of the ends of the cross member being in fluid communication with the longitudinal member; and wherein the ladder includes a plurality of buttresses, each of the buttresses extending between one of the rails and a medial region of one of the rungs, each of the buttresses being substantially tubular.

* * * * *